United States Patent [19]

Smith

[11] 3,955,326

[45] May 11, 1976

[54] FINISHING MACHINE

[75] Inventor: Eric Francis Smith, Wembley, England

[73] Assignee: Fox Chemical & Engineering Limited, London, England

[22] Filed: Mar. 17, 1975

[21] Appl. No.: 558,812

[52] U.S. Cl. ..... 51/163 R
[51] Int. Cl.[2] ..... B24B 31/00
[58] Field of Search ..... 51/163, 7; 241/175

[56] References Cited

UNITED STATES PATENTS

| | | | |
|---|---|---|---|
| 2,789,773 | 4/1957 | Stauber | 241/175 X |
| 2,818,220 | 12/1957 | Woody | 241/175 X |
| 3,021,082 | 2/1962 | Sullivan | 241/175 |
| 3,161,993 | 12/1964 | Balz | 51/163 |
| 3,246,429 | 4/1966 | Ruppe | 51/163 X |
| 3,392,925 | 7/1968 | Moore | 51/163 X |
| 3,400,495 | 9/1968 | Balz | 51/163 V |
| 3,611,638 | 10/1971 | Deede | 51/163 X |

*Primary Examiner*—Harold D. Whitehead
*Attorney, Agent, or Firm*—Baldwin, Wight & Brown

[57] ABSTRACT

A finishing machine comprises a chamber which is mounted for vibratory motion about a horizontal axis. Finishing medium in the chamber is induced to flow in a generally helical path and is recirculated by means of a tray mounted externally of the chamber and connecting an exit opening with an entry opening which is laterally spaced from and lower than the exit opening.

13 Claims, 4 Drawing Figures

FINISHING MACHINE

This invention relates to finishing machines, especially to those having a vibratory motion.

Finishing machines may be of several different types and normally include a finishing chamber in which the articles to be finished are enclosed along with a finishing medium, for example, bodies or shapes of graded natural minerals, ceramics, bonded abrasives or plastics. The articles may then be tumbled within the chamber, but this is frequently unsuitable because of the danger of damage to the articles. Alternatively, the articles may be vibrated while in contact with the finishing medium.

In such a vibratory machine, it is desirable that the machine incorporates a device for separating the finished articles from the finishing medium without the need for emptying the chamber completely. In known machines having such an arrangement either the separating device is itself relatively mechanically complex or the chamber must be constructed with a complex interior structure to achieve the desired separation.

The present invention provides a vibratory finishing machine of extremely simple construction, which can be operated continuously and with a high throughput of articles which are readily separated from the finishing medium.

According to the invention, a finishing machine comprises a finishing chamber mounted resiliently for vibratory motion about a substantially horizontal axis, the finishing chamber having an entry opening for an article to be finished and an exit opening for the finished article, the exit opening being connected to the entry opening so that a finishing medium can be recirculated and the finished article collected, the entry opening being laterally spaced from and below the exit opening.

Preferably, the finishing chamber is mounted on at least two resilient means, preferably coil springs, acting at an angle to each other. Preferably also, the chamber is mounted horizontally on at least two pairs of springs, at least one pair at each end of the drum, and each spring of a pair acting at an angle of 45° to the horizontal.

The chamber is vibrated by means of a motor which, conveniently, drives an eccentrically balanced shaft mounted in bearings on the ends of the chamber and extending through a central tube of the chamber.

In a preferred embodiment, the entry and exit openings are located at opposite ends of the chamber and are connected externally of the drum by a channel extending horizontally along the outside of the chamber and running substantially horizontally between the two openings. The channel preferably ends in a substantially vertical chute leading to the entry opening. The channel may comprise a separator screen over an elongated tray having a screen surface which allows the finishing medium to fall through to the base of the tray, there to be carried to the entry opening and circulated, and which retains the finished article. The tray may further include a fine sieve screen to separate out particles of the finishing medium which are undersize. Preferably also, means are provided for rinsing articles in the tray.

Guiding or deflector plates may be provided within the chamber near the entry and exit openings. The entry deflector plate is preferably in the form of a spiral and extends round the circumference of the drum for about 1¼ revolutions and thus guides the finishing medium into a substantially helical path. The exit deflector plate also preferably extends in a spiral at an angle to the exit end of the drum and over at least the top half of the annular area so that the medium and the articles are guided to the exit.

In an embodiment which is particularly preferred when the finishing machine is to be used for relatively large articles, a foraminous baffle is located adjacent the entrance end of the drum and extending round between one-third and one-half of the circumference of the drum from the entry opening. This baffle guides the articles round the outer periphery of the chamber while allowing the finishing medium to pass through; thus the circulation of medium is not adversely affected while the articles are guided into their optimum path.

A preferred embodiment of the invention is now described with reference to the accompanying schematic drawings in which.

Figure 3:
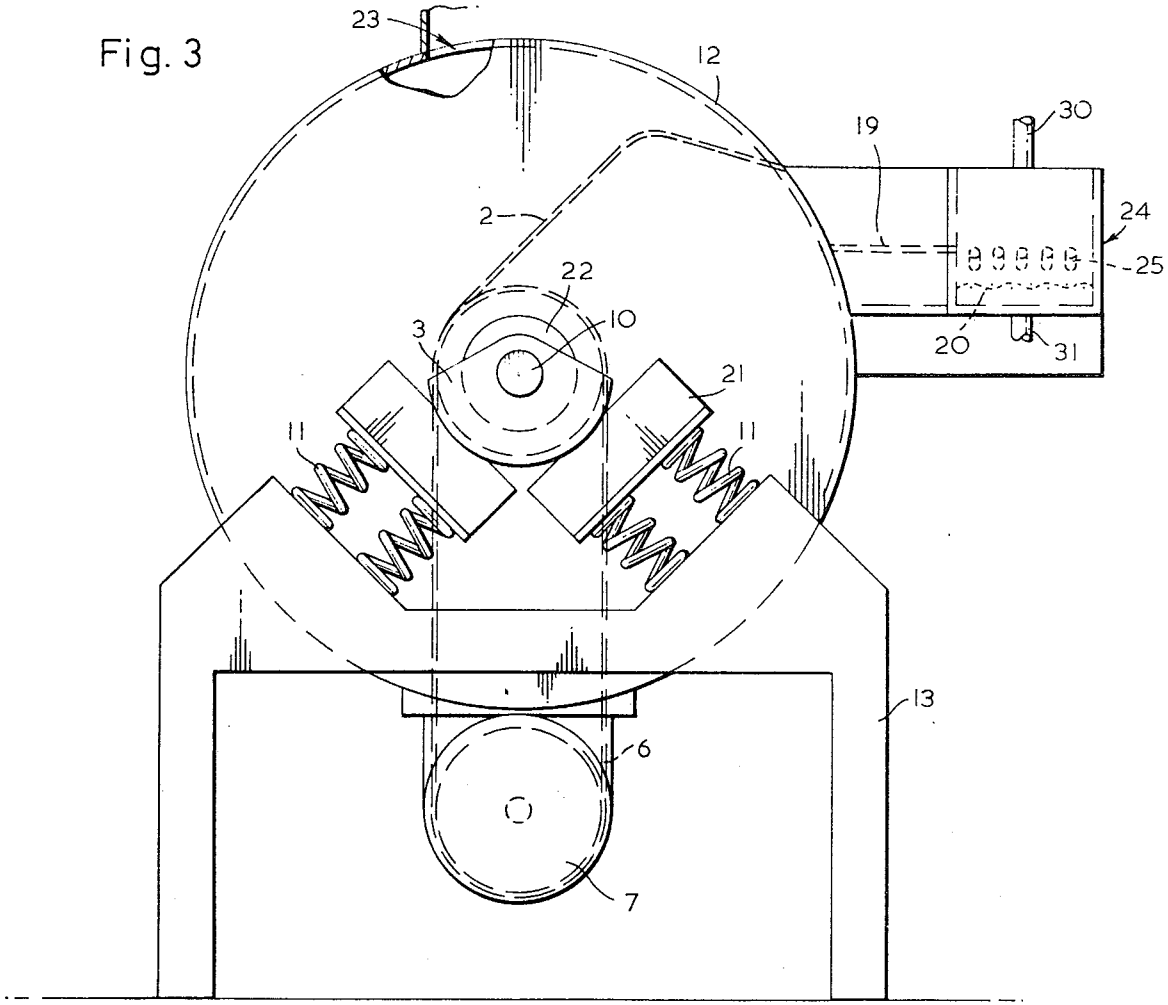
FIG. 3 is an end view of the machine.

The finishing machine comprises a cylindrical drum 12 which is spring-mounted on a frame 13. Two pairs of springs 11, one pair at each end, extend between the frame and angle plates 21 secured to the ends of the drum. As can be clearly seen in FIG. 3, one spring of each pair acts at an angle of 90° to the other spring of each pair. In this case, each spring is in fact itself a double spring.

Centrally on each end of the drum is mounted a bearing 22. The bearings receive a drive shaft 10 extending through the drum and carrying an eccentric weight 3 at each end. The drive shaft 10 is driven by means of a drive belt 6 from a motor 7 located either on the base of the frame or on the drum 12.

Rotation of the drive shaft thus induces the desired vibratory motion of the drum.

Surrounding the drive shaft and extending along the central axis of the drum is a hollow centre tube 8 so that the operative finishing region of the drum is in the form of an annular cylinder. Two openings are provided in the upper surface of the drum, an entry opening 5 adjacent to one end and an exit opening 23 adjacent to the other end. It is advantageous that the exit opening should be as high as possible so as to cause a back pressure within the drum. The size of the exit opening may also be varied to change the back pressure.

Extending around the interior of the drum adjacent the entry opening 5 is a foraminous baffle 33 which is formed from a plurality of parallel spaced curved rods 18, the spacing between the rods 18 being sufficient to allow passage of the medium in the drum but not to allow the article being finished to pass through. This arrangement allows the medium to circulate in an uninterrupted signal flow, while the articles are guided into the outer and fastest moving region of the medium flow.

The foraminous baffle may be formed by a wire grid or mesh rather than by parallel spaced rods, especially when the finishing of smaller articles is envisaged.

Externally of the drum and spaced therefrom there is mounted a housing indicated generally at 24 extending as a tray between the exit opening 23 and the entry opening 5. Articles fed out from the exit opening along with the finishing medium pass along a short passageway 19 and fall on to this tray which is provided with longitudinal rib bars 25 which retain the articles but allow the medium to travel along the chute to the entry opening where it is recirculated. While it is advantageous for the chute to have a slight downward slope between exit and entry openings, this is not essential as the vibratory motion of the machine suffices to carry the medium along. Indeed, there may even be an upward slope.

The tray 24 also includes a fine mesh separator 20 through which undersized particles of finishing medium may pass. Also provided in the housing 24 is a water inlet pipe 30 which provides for a spray of rinse water to clean finished articles as they pass along the bars 25. Excess water passes through the mesh 20 along with the undersize finishing medium and may be collected via the pipe 31.

At the end of the tray 9, the finished articles are retained on the rib bars 25, while the finishing medium is deflected along the passage 32 to the entry opening 5.

Figure 2:
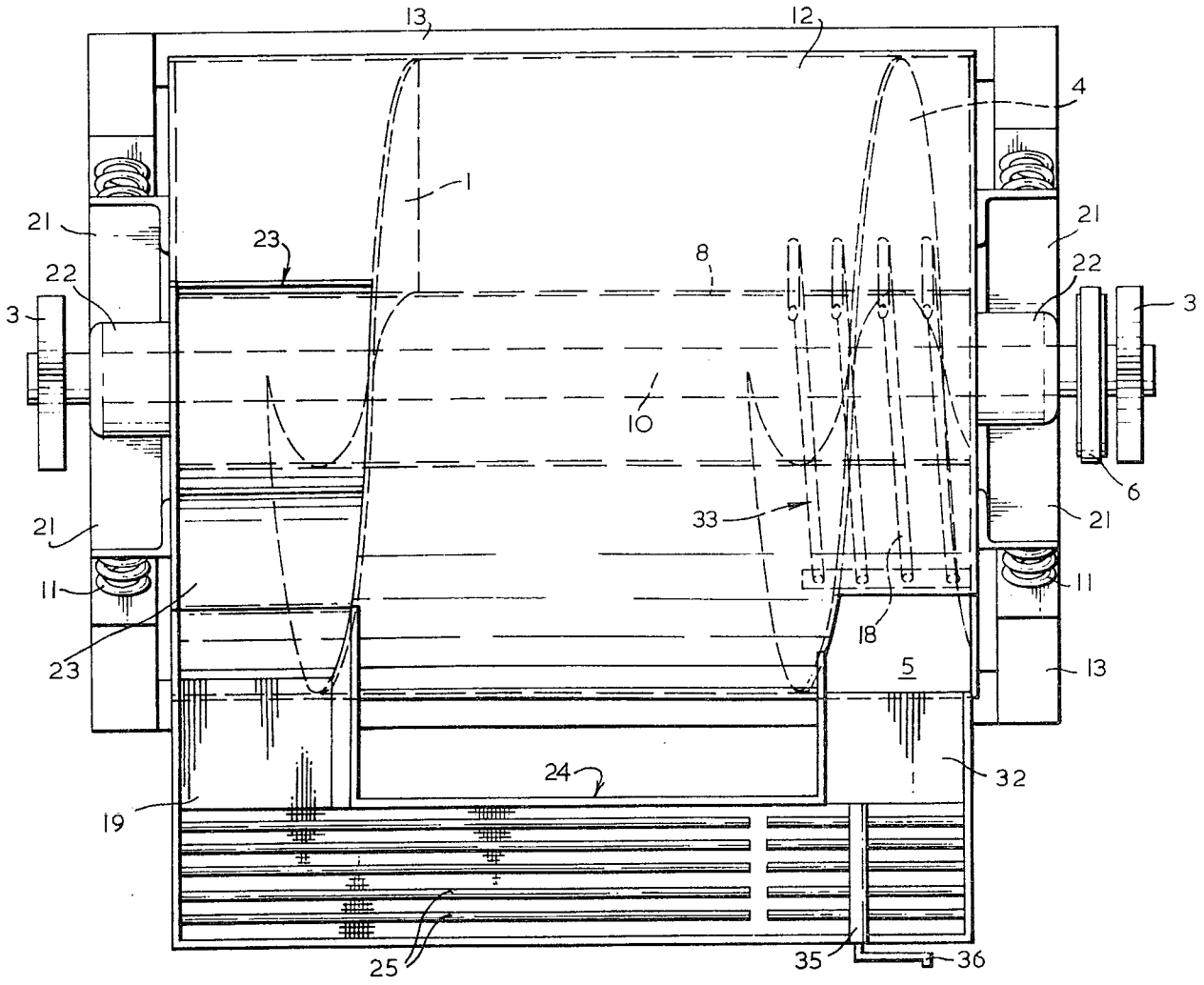
FIG. 2 is a plan view of the machine.

As can be seen in FIG. 2, the end portions of the rib bars 25 are separate from the main bars and are mounted for pivotal movement on an axle 35. Handle 36 connected to the axle 35 may be turned to move the end portions of the bars 25 in a clockwise direction so that, if desired, a part-finished article may fall through and be deflected with the medium to the passage 32 in order to be recirculated.

Figure 4:
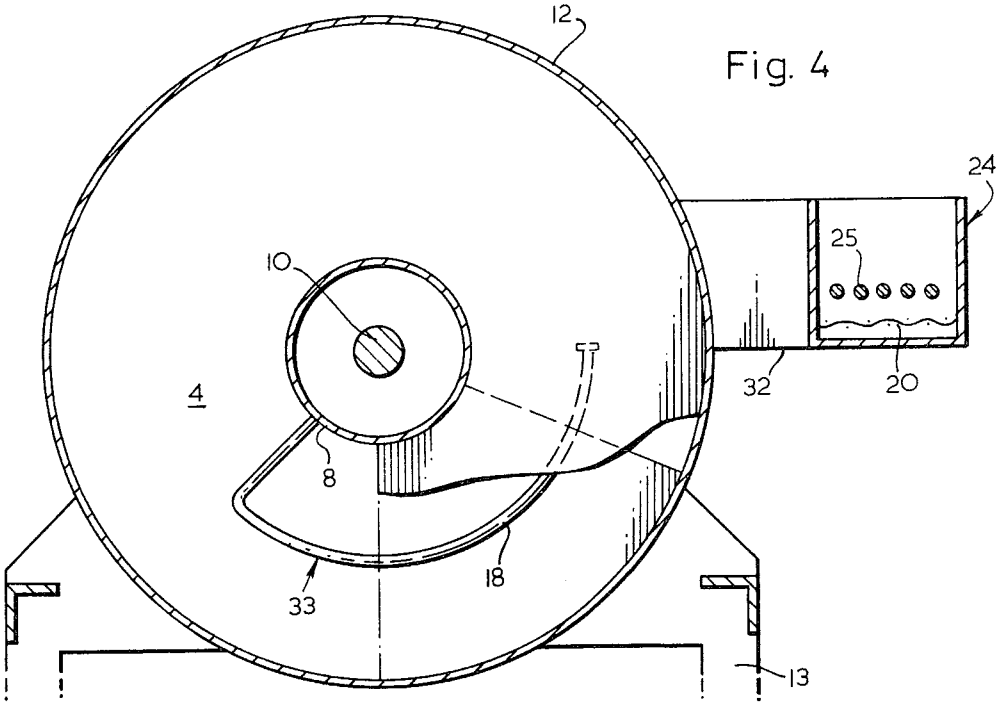
FIG. 4 is a section along the line IV — IV of FIG. 1.

The passage of articles between the entry and exit openings inside the finishing chamber is assisted by deflector plates. An entry deflector plate 4, best seen in FIGS. 2 and 4, is provided adjacent the entry opening 5 and comprises a spiral coil which extends between the center tube and the inner surface of the drum at an angle to the end of the drum. This spiral coil ensures that articles fed into the entry opening 5 are propelled along a helical path near to the outer periphery of the annulus, thus ensuring that the path followed by the article is adequately long.

Figure 1:
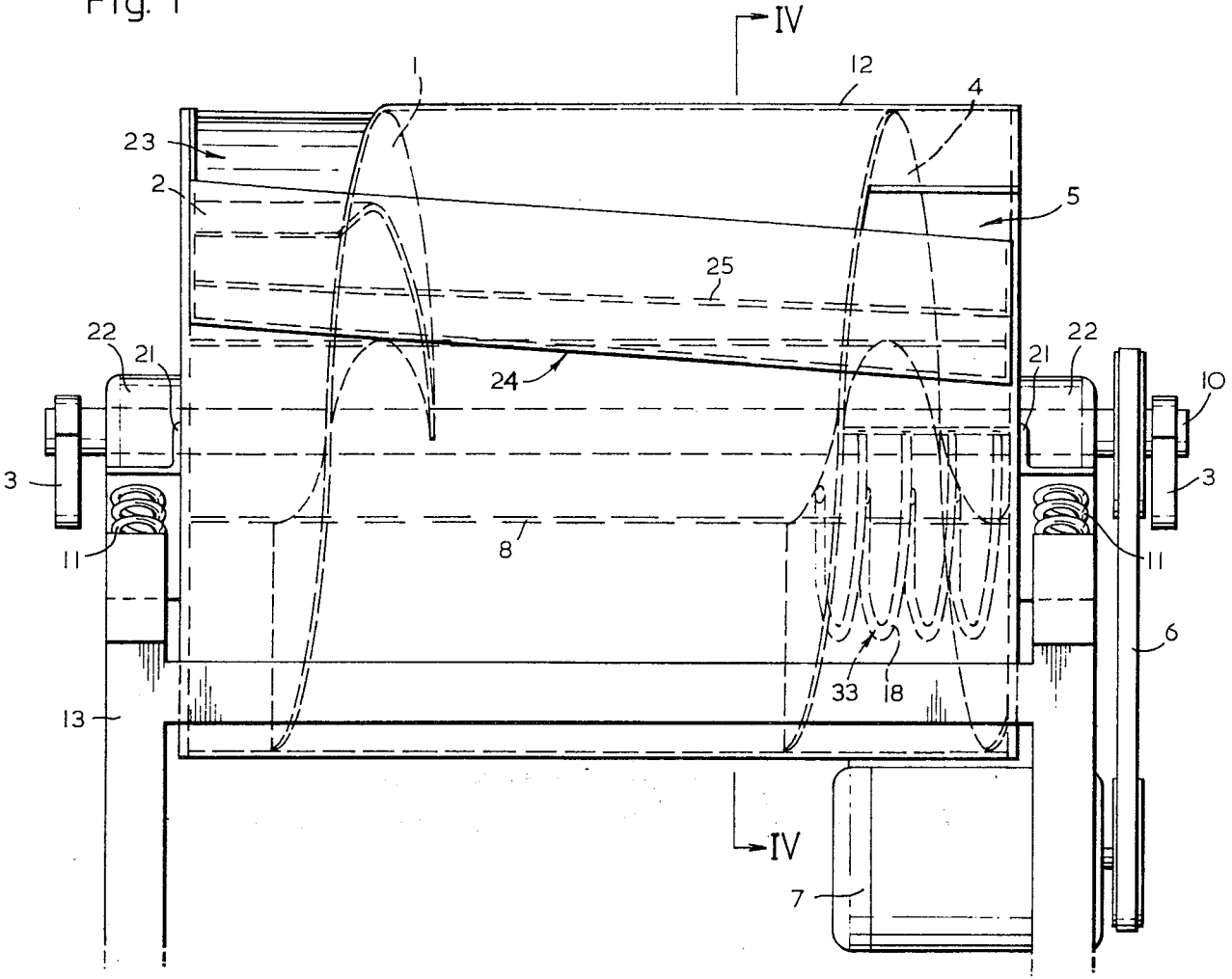
FIG. 1 is a front elevation of a finishing machine.

An exit deflector plate 1, as seen in FIGS. 1 and 2 similarly extends round the annulus area in the vicinity of the exit end of the drum. This plate 1 leads the finished articles and the medium on to a riser plate 2 which in turn leads to the exit opening 23 above the level of the separator screen 25.

In use, substantially the entire annular chamber volume is filled with the finishing medium and the motor is run. An article to be finished may then be fed into the entry opening followed at a suitable interval by a second article, and so on. The articles are then conveyed round the drum while being finished and are ejected from the exit opening where they may be easily collected. The medium thus continuously travels round the machine and need only be replenished as any abraded undersize particles are sieved off.

Where continuous operation is not appropriate, for example when articles require longer finishing time, the end portions of the rib bars 25 are pivoted so as to allow the articles to be returned to the interior of the medium.

What is claimed is:

1. A finishing machine comprising a finishing chamber; resilient means mounting said finishing chamber for vibratory motion about a substantially horizontal axis; an entry opening in said finishing chamber for an article to be finished, said entry opening being adjacent one end of said chamber; an exit opening in said chamber for the finished article, said exit opening being adjacent the other end of said container and laterally spaced from and above the entrance opening; said finishing chamber having an intermediate finishing region disposed between said entry opening and said exit opening, a spiral entry deflector plate adjacent both said entry opening and said finishing region for guiding an article and a finishing medium into said finishing region; a spiral exit deflector plate adjacent both said exit opening and said finishing region for guiding an article and a finishing medium from said finishing region to said exit opening; said finishing region being in the form of an annular, tubular passage extending between said deflector plates; and means connecting said exit opening to said entry opening so that the finishing medium can be recirculated and the finished article collected.

2. The finishing machine of claim 1 in which said finishing chamber is mounted adjacent said horizontal axis on at least two resilient means acting at an angle to each other.

3. The finishing machine of claim 2 in which said resilient means are coil springs.

4. The finishing machine of claim 3 in which the said resilient means comprises at least two pairs of springs with there being at least one pair of said springs at each end of said finishing chamber.

5. The finishing machine of claim 4 in which each spring of each pair of said springs acts at an angle of 45° to the horizontal.

6. The finishing machine of claim 1 together with bearings on ends of said finishing chamber, a central tube extending through said finishing chamber generally coaxial with said horizontal axis, an eccentrically balanced shaft extending through said central tube and journalled in said bearings, and means driving the said shaft to vibrate said finishing chamber.

7. The finishing machine of claim 1 in which the said means connecting the openings includes a base tray and a separator screen for finished articles, which screen allows finishing medium to fall through to said base tray.

8. The finishing machine of claim 7 in which said base tray includes a mesh screen for separating undersize particles of finishing medium.

9. The finishing chamber of claim 7 in which at least part of the separator screen is movable so as to deflect the said articles into said base tray for recirculation through the finishing chamber.

10. The finishing chamber of claim 1 in which foraminous means are provided within said finishing chamber adjacent said entry opening to guide the said articles around the periphery of said finishing chamber.

11. The finishing machine of claim 10 in which the said foraminous means comprise a plurality of spaced parallel rods extending partially around the annular space formed by said finishing chamber.

12. The finishing machine of claim 6 wherein said resilient means are connected to said finishing chamber immediately adjacent said bearing means.

13. The finishing machine of claim 6 wherein said resilient means are connected to said finishing chamber immediately adjacent said bearing means, and in centered intersecting relation with said horizontal axis.

* * * * *